US005634610A

United States Patent [19]

Walsh

[11] Patent Number: 5,634,610

[45] Date of Patent: Jun. 3, 1997

[54] PORTABLE WIRE DISPENSER

[76] Inventor: Robert E. Walsh, 32 Mangrove La., Key Largo, Fla. 33037

[21] Appl. No.: 494,106

[22] Filed: Jun. 23, 1995

[51] Int. Cl.[6] ..... B65H 49/00

[52] U.S. Cl. ..... 242/588.3; 242/422.4; 242/594.2; 242/595

[58] Field of Search ..... 242/595, 595.1, 242/588.2, 588.3, 588.6, 422.4, 129.5, 129.8, 132, 137, 137.1, 138, 146, 594.1, 594.2

[56] References Cited

U.S. PATENT DOCUMENTS

| | | | |
|---|---|---|---|
| 192,914 | 7/1877 | Hamilton . | |
| D. 253,022 | 10/1979 | Sligh | D6/85 |
| D. 304,534 | 11/1989 | Gustafson | D6/469 |
| 2,628,042 | 2/1953 | Fitts et al. | 242/146 |
| 2,748,931 | 6/1956 | Taylor | 206/52 |
| 2,805,029 | 9/1957 | Fanning | 242/422.4 |
| 3,105,654 | 10/1963 | Czapla | 242/110.3 |
| 3,166,187 | 1/1965 | Araujo | 242/588.6 |
| 3,337,158 | 8/1967 | Ball | 242/139 |
| 3,371,885 | 3/1968 | Douglas | 242/129 |
| 3,383,071 | 5/1968 | Godson | 242/129.6 |
| 3,602,455 | 8/1971 | Lewis | 242/129 |
| 3,722,825 | 3/1973 | Phillips et al. | 242/129 |
| 3,837,597 | 9/1974 | Bourhenne | 242/129 |
| 3,902,679 | 9/1975 | Bost | 242/129 |
| 3,907,228 | 9/1975 | Lewis | 242/129 |
| 3,990,653 | 11/1976 | Marcell | 242/129.8 |
| 4,006,854 | 2/1977 | Gibson et al. | 229/17 S |
| 4,015,795 | 4/1977 | Chong . | |
| 4,072,278 | 2/1978 | Petersen | 242/405.3 X |
| 4,083,268 | 4/1978 | Kober | 81/9.5 R |
| 4,253,624 | 3/1981 | Colbert | 242/128 |
| 4,284,180 | 8/1981 | Masters | 242/405.3 X |
| 4,306,687 | 12/1981 | Hadtke | 242/138 X |
| 4,408,730 | 10/1983 | Shend'ge et al. | 242/96 |
| 4,471,921 | 9/1984 | Corbin | 242/129 |
| 4,533,091 | 8/1985 | Knight et al. | 242/129.6 |
| 4,537,106 | 8/1985 | Rider | 242/129.5 X |
| 4,552,323 | 11/1985 | Otis . | |
| 4,739,943 | 4/1988 | Geller | 242/590 |
| 4,827,818 | 5/1989 | Stringfellow | 242/595.1 X |
| 4,869,344 | 9/1989 | Peterson | 182/129 |
| 4,978,085 | 12/1990 | Letourneau | 242/588.3 |
| 4,979,693 | 12/1990 | Eberhardt et al. | 242/405.3 X |
| 5,139,210 | 8/1992 | Schaffer | 242/129 |
| 5,152,395 | 10/1992 | Cross | 206/389 |
| 5,267,705 | 12/1993 | Hofrichter et al. | 242/137.1 X |

*Primary Examiner*—Daniel P. Stodola
*Assistant Examiner*—William A. Rivera
*Attorney, Agent, or Firm*—Pennie & Edmonds LLP

[57] ABSTRACT

A portable wire dispenser for holding and dispensing one or more spools of electrical wire or television or computer cable. The wire dispenser of the invention allows for replacement of exhausted wire spools without disturbing remaining non-exhausted wire spools, and provents free spinning of wire spools as wire is dispensed. The wire dispenser of the invention is particularly suitable for use at construction sites, including industrial locations and home building sites, and for cable television and computer network installation.

14 Claims, 1 Drawing Sheet

PORTABLE WIRE DISPENSER

BACKGROUND OF THE INVENTION

1. Field of the Invention

This invention generally relates to a wire dispenser for holding and dispensing one or more spools of electrical wire or television or computer cable. The wire dispenser of the invention is particularly suitable for use at construction sites, including industrial locations and home building sites, and for cable television and computer network installation.

2. Description of the Prior Art

An efficient and convenient means for dispensing electrical wire and television or computer cable would be useful in a wide variety of applications. For example, electricians must often dispense large quantities of electrical wire at industrial or home construction sites; cable television providers must dispense large quantities of cable at cable television installation sites; and computer hardware providers must dispense large quantities of computer cables in offices or other locations where, for example, computer networks are being installed. In all of these applications, a means by which the electrical wire or television or computer cable is dispensed should have certain characteristics to provide maximum efficiency and convenience to the user.

First, a dispenser of electrical wire or television or computer cable, hereinafter referred to simply as a wire dispenser, should hold a plurality of wire spools. Second, the wire spools should be directly observable to check the amount of wire remaining on each spool. Third, each wire spool should be easily replaced when it becomes exhausted without having to remove other spools which are not yet exhausted. Fourth, a means should be provided to prevent the wire spools from spinning freely as wire is dispensed therefrom. Free spinning is a problem in those wire dispensers where it occurs because it results in the unnecessary dispensing of wire before it is needed. Finally, the wire dispenser should be portable, i.e., it should be capable of being carried manually to different sites as needed.

The use of dispensers for containing and dispensing electrical wire is known in the art. For example, U.S. Des. Pat. No. D-304,534 to Gustafson for a wire dispenser rack discloses an ornamental design for a wire dispenser rack which comprises a series of shelves on which wire spools can be stored and dispensed. However, the size of the rack renders it cumbersome and thereby reduces its portability.

U.S. Pat. No. 4,083,268 to Kober for an electrical wire dispenser with cutter and stripper provides a housing for dispensing a single spool of wire, but requires disassembly of the dispenser housing to replace an exhausted spool of wire and does not allow for the incorporation of multiple wire spools.

U.S. Pat. No. 4,006,854 to Gibson et al. for a wire dispenser container discloses a paperboard container adapted to hold and dispense a single spool or roll of wire. As with the Kober patent, above, this dispenser requires disassembly to replace an exhausted spool of wire, and does not provide for multiple spools of wire. In addition, since the paperboard container encloses the wire spool, the amount of wire remaining on the spool cannot be easily determined.

U.S. Des. Pat. No. D-253,022 to Sligh discloses an ornamental design for a combined rack and dispenser for spooled wire. However, use of this rack design at a construction site has several drawbacks. First, the rack is too large to be easily portable. Second, since a plurality of wire spools are held in place with a rod commonly running through their center holes, replacement of one exhausted spool requires removal of several spools at the same time. Third, no means are provided to prevent a wire spool from spinning freely when a user pulls wire from the spool.

U.S. Pat. No. 5,152,395 to Cross discloses a wire carrier and method of using the same. However, the carrier is adapted to carry specifically determined lengths of wire for specialized applications, rather than spools of wire for general use.

Accordingly, there is a need for a wire dispenser that can hold a plurality wire spools, that allows direct observation of the wire spools to determine how much wire remains on each spool, that allows each wire spool to be easily replaced when it becomes exhausted, that provides means to prevent free spinning of wire spools, and that is portable.

SUMMARY OF THE INVENTION

In accordance with the present invention, there is provided a wire dispenser that can hold a plurality of wire spools, in which the spools can be directly observed to determine how much wire remains on each spool, in which each wire spool is easily replaced as it becomes exhausted, in which means are provided to prevent free spinning of wire spools, and that is portable.

Thus, the present invention specifically relates to a wire dispenser comprising a housing having first and second side walls which are retained in spaced relation; at least one support member associated with the first and second side walls for holding a spool of wire, facilitating rotation thereof for dispensing wire, and to provide sufficient frictional resistance against the wire spool to prevent free spinning when wire is dispensed therefrom; and a rotatable member associated with the first and second side walls for retaining the wire spool on the support member while the spool is rotating to dispense wire.

This dispenser may include means for displacing the rotatable member away from the wire spool to facilitate removal or replacement of the wire spool from the support. This displacing means can be a rod member provided on at least one end of the longitudinal axis of the rotatable member and at least one slot defined by the first or second side wall for receiving the rod member. Preferably, the displacing means includes a rod member provided on each end of the longitudinal axis of the rotatable member and first and second elongated slots defined in each of the first and second side walls, respectively, for receiving the rod members. Advantageously, the rotatable member is a cylindrical bar and each rod member is a screw which passes through its respective slot and into the longitudinal axis of the cylindrical bar.

The support member preferably comprises a plate having a sufficient radius to hold and retain a wire spool thereon, and the support and rotatable members are of a length sufficient to retain a plurality of wire spools in adjacent relation. The support member may have a hemicylindrical portion extending from a first edge which is disposed above the longitudinal axis of the wire spool to be retained thereon but below the uppermost circumferential edge of the wire spool, to a second edge disposed below the longitudinal axis of the wire spool but above the lowermost circumferential edge of wire spool. In this arrangement, the first edge may be configured to have a different radius than the hemicylindrical portion to facilitate placement of the wire spool thereon.

The wire dispenser can include one or more wire spools, preferably a plurality of spools each of the same size.

The invention also relates to a method of dispensing wire comprising storing a wire spool in the wire dispenser described above and dispensing wire from the dispenser. The support and rotatable members are configured to provide increased frictional forces on the wire spool to dispense wire in a controlled manner without free spinning of the spool. Preferably, the wire spool is oriented on the support member so that wire feeds from the spool between the first edge of the support member and the rotatable member.

DETAILED DESCRIPTION OF THE PREFERRED EMBODIMENTS

Figure 1:
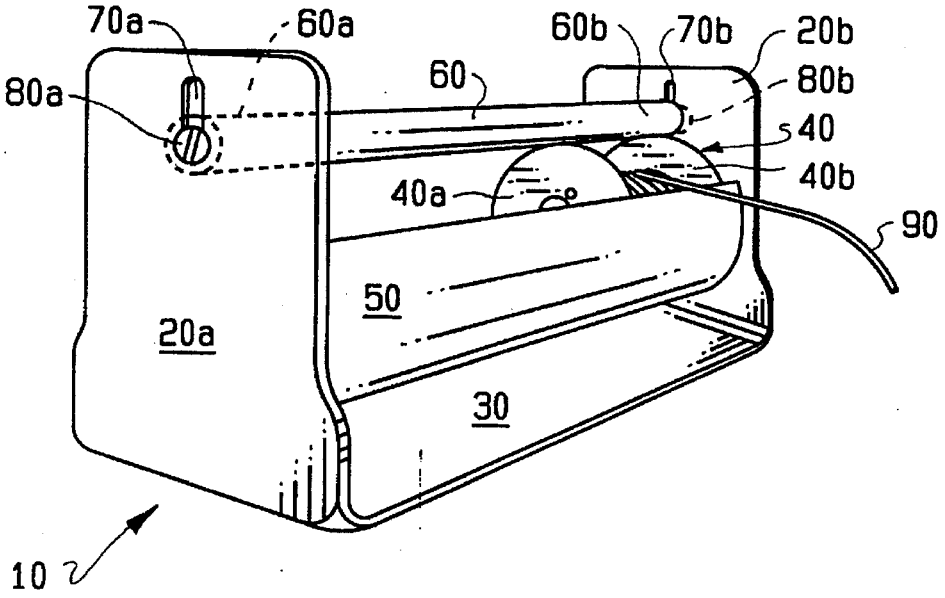
FIG. 1 is a perspective view of the housing of the wire dispenser of the invention containing a single wire spool from which a length of wire is being dispensed in accordance with the present invention.
Figure 2:
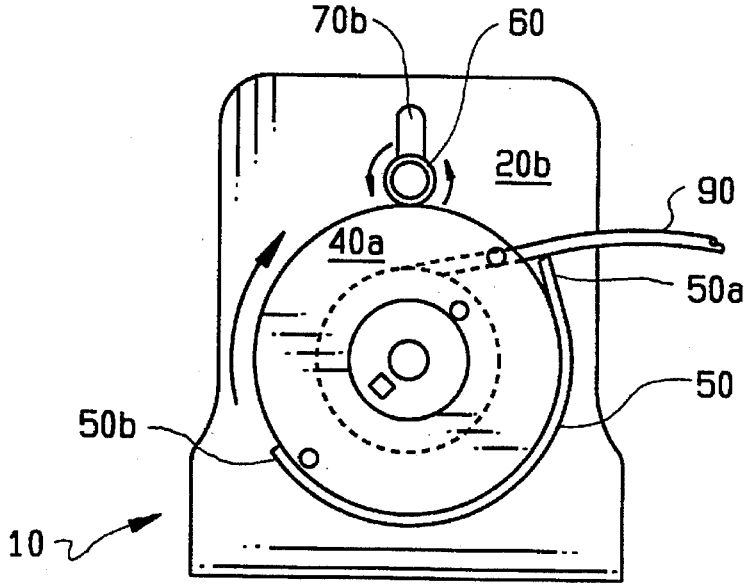
FIG. 2 is a cut-away end-on view of the housing of the wire dispenser of the invention containing a wire spool from which a length of wire is being dispensed in accordance with the present invention.

Referring initially to FIGS. 1 and 2, there is illustrated a wire dispenser comprising a housing 10 containing a single wire spool 40 from which a length of wire 90 is being dispensed.

Housing 10 of the wire dispenser of the invention comprises first and second side walls, 20*a* and 20*b*, retained in a spaced relation by attachment at their bottom edges to opposite ends, respectively, of a flat bottom portion 30 of sufficient length to hold at least one wire spool 40 as illustrated in FIG. 1. Side walls 20*a* and 20*b* further comprise elongated slots 70*a* and 70*b*, respectively, situated in upper portions of side walls 20*a* and 20*b*, respectively.

Side walls 20*a* and 20*b* and bottom portion 30 may be constructed from a single blank of material which is appropriately cut and shaped to produce side walls 20*a* and 20*b* and bottom portion 30 as illustrated in FIG. 1. Alternatively, side walls 20*a* and 20*b* and bottom portion 30 may be separately constructed and attached together as illustrated in FIG. 1 using any standard type of fastening devices, such screws or rivets, or using any standard fastening compound, such as any appropriate adhesive compound, or using any standard method such as welding, or any combination thereof.

Housing 10 of the wire dispenser of the invention further comprises a support member 50 which is preferably a sheet or plate having a hemicylindrical portion that is attached to side walls 20*a* and 20*b* as illustrated in FIGS. 1 and 2. Support member 50 preferably has a radius sufficient to hold a wire spool 40 as illustrated in FIG. 2. Support member 50 is attached to side walls 20*a* and 20*b* so that a first edge 50*a* of support member 50 is preferably disposed above the central radial axis of wire spool 40 but below the uppermost circumferential edge of spool 40, and so that a second edge 50*b* of support member 50 is disposed below the central radial axis of wire spool 40 but above the lowermost circumferential edge of wire spool 40. First edge 50*a* is configured to have a different radius than the hemicylindrical portion of support member 50 to facilitate placement of the wire spool thereon.

In an alternative embodiment, support member 50 of housing 10 may also serve to retain first and second side walls 20*a* and 20*b* in a spaced relation, and a bottom portion may thereby be omitted.

The support member of housing 10 may alternatively comprise one or more elements that serve to hold wire spool 40 in a position similar to that illustrated in FIG. 2 and allow wire 90 to be dispensed as illustrated in FIGS. 1 and 2. For example, a support member may comprise a plurality of rods attached to first and second side walls 20*a* and 20*b*, which rods are configured to hold wire spool 40 in a position similar to that illustrated in FIG. 2 and allow wire 90 to be dispensed as illustrated in FIGS. 1 and 2. Alternatively, a support member may comprise first and second sheetlike portions attached together to form a V-shaped configuration in which wire spool 40 may be held in a position similar to that illustrated in FIG. 2 and allow wire 90 to be dispensed as illustrated in FIGS. 1 and 2.

Housing 10 of the wire dispenser of the invention further comprises a rotatable member 60, in this embodiment a cylindrical bar, associated with first and second side walls 20*a* and 20*b* for retaining wire spool 40 on support member 50 while wire spool 40 is rotating to dispense wire. Rotatable member 60 is rotatably attached at a first end 60*a* and a second end 60*b* to side walls 20*a* and 20*b*, respectively, through slots 70*a* and 70*b*, respectively, using fastening devices 80*a* and 80*b* which pass through slots 70*a* and 70*b*, respectively, and into the longitudinal axis of rotatable member 60. Fastening devices 80*a* and 80*b* may comprise any type of fastening device that will serve to rotatably attach first and second ends 60*a* and 60*b* of rotatable member 60 to side walls 20*a* and 20*b* through slots 70*a* and 70*b*, but that will allow first and second ends 60*a* and 60*b* of rotatable member 60 to be displaced to facilitate removal or replacement of wire spool 40 from support member 50. Such fastening devices may comprise, for example, first and second screws 80*a* and 80*b* that pass through slots 70*a* and 70*b*, respectively, and into the longitudinal axis of rotatable member 60, in which first and second screws 80*a* and 80*b* have screw head diameters larger than the radius of slots 70*a* and 70*b*, respectively, thereby serving to rotatably attach first and second ends 60*a* and 60*b* of rotatable member 60 to side walls 20*a* and 20*b*, respectively, through slots 70*a* and 70*b*, respectively, and allowing rotatable member 60 to be displaced away from wire spool 40 to facilitate removal or replacement of wire spool 40 from support member 50.

Various components of housing 10 of the wire dispenser of the invention, including side walls 20*a* and 20*b*, bottom portion 30, support member 50, and rotatable member 60 may be made of any appropriate material that is both durable and easy to machine, including sheet metal, plexiglass, a high impact plastic such as LEXAN, or any combinations or variations thereof.

One or more wire spools from which wire is to be dispensed are preferably oriented in support member 50 of housing 10 of the wire dispenser of the invention as illustrated in FIGS. 1 and 2. Radial end plates 40*a* and 40*b* of wire spool 40 are preferably of sufficient diameter to contact the lowermost surface of rotatable member 60 when rotatable member 60 is in a resting position, as illustrated in FIGS. 1 and 2. Wire 90 preferably feeds from wire spool 40 over first edge 50*a* of support member 50 and under rotatable member 60. As wire 90 feeds from wire spool 40, the feeding of wire 90 causes wire spool 40 to rotate in a clockwise direction, as illustrated in FIG. 2. The rotation of wire spool 40 in a clockwise direction causes rotatable member 60 to rotate in a counter-clockwise direction, as illustrated in FIG. 2.

As wire 90 is fed from wire spool 40, wire spool 40 is retained in position within support member 50 by both the extension of first edge 50*a* of support member 50 above the central radial axis of wire spool 40 and by the resting weight of rotatable member 60 down against the uppermost edge of radial end plates 40*a* and 40*b* of wire spool 40.

As illustrated in FIGS. 1 and 2, support member 50 and bottom portion 30 are preferably of sufficient length to hold a plurality of wire spools.

Housing 10 of the wire dispenser of the invention permits direct observation of the wire spools contained therein to determine the amount of wire remaining on each wire spool.

When a wire spool 40 becomes exhausted, it is easily removed without having to dislodge any other wire spools contained in the wire dispenser. An exhausted wire spool is removed and replaced simply by displacing rotable member 60 away from wire spool 40, removing the exhausted wire spool and replacing it with a fresh wire spool.

The weight of wire spool 40 against support member 50 provides sufficient frictional force to serve as a means to prevent wire spool 40 from free spinning when wire 90 is dispensed.

Finally, rotatable member 60 serves as a handle by which housing 10 of the wire dispenser of the invention may be lifted and moved to a different location. Upon grasping rotatable member 60 by hand, rotatable member 60 displaces away from contact with wire spool 40 within the confines of slots 70*a* and 70*b* to provide sufficient space between the lowermost surface of rotatable member 60 and the uppermost edge of radial end plates 40*a* and 40*b* of wire spool 40 for the user's hand to fit and grasp rotatable member 60 while housing 10 of the wire dispenser of the invention is being carried.

I claim:

1. A portable wire dispenser comprising:

a housing having first and second side walls which are retained in spaced relation;

at least one support member connecting the first and second side walls for supporting at least one removable spool of wire having at least one end plate, for facilitating rotation of the wire spool for dispensing wire, and for providing sufficient frictional resistance against the wire spool to prevent free spinning when wire is dispensed therefrom; and a rotatable member placed between and connecting the first and second side walls for providing a force on said at least one end plate of the spool to retain frictional contact between the spool end plate and the support member while the spool is rotating to control the dispensing of the wire.

2. The wire dispenser of claim 1, further comprising means for displacing the rotatable member to facilitate removal or replacement of a spool from the support member.

3. The wire dispenser of claim 2, wherein the means for displacing the rotatable member comprises a rod member provided on at least one end of the longitudinal axis of the rotatable member and at least one slot defined by one of the first and second side walls for receiving the rod member.

4. The wire dispenser of claim 3, wherein the displacing means comprises a rod member provided on each end of the longitudinal axis of the rotatable member and first and second elongated slots defined in each of the first and second side walls, respectively, for receiving the rod members.

5. The wire dispenser of claim 3, wherein the rotatable member is a cylindrical bar and the rod member is a screw which passes through the slot and into the longitudinal axis of the cylindrical bar.

6. The wire dispenser of claim 1, wherein the support member comprises a plate having a sufficient radius to hold and retain a wire spool thereon.

7. The wire dispenser of claim 6, wherein the support member has a hemicylindrical portion extending from a first edge which is disposed above the longitudinal axis of the wire spool to be retained thereon but below the uppermost circumferential edge of the wire spool, to a second edge disposed below the longitudinal axis of the wire spool but above the lowermost circumferential edge of wire spool.

8. The wire dispenser of claim 7, wherein the first edge is configured to have a different radius than the hemicylindrical portion to facilitate placement of the wire spool thereon.

9. The wire dispenser of claim 6 wherein the rotatable member provides sufficient force to maintain at least one spool in contact with the radius of the plate to prevent free spinning of the wire when dispensed.

10. The wire dispenser of claim 1 wherein the rotatable member is positioned above the wire spools and is in contact with an outer side of the spool to provide said force.

11. The wire dispenser of claim 10 wherein the rotatable member is movable away from the spools to be used as a handle for carrying the wire dispenser.

12. In combination, a wire dispenser comprising:

a housing having first and second side walls which are retained in spaced relation;

at least one support member connecting the first and second side walls for supporting at least one removable spool of wire having at least one end plate, for facilitating rotation of the wire spool for dispensing wire, and for providing sufficient frictional resistance against the at least one end plate of the wire spool to prevent free spinning when wire is dispensed therefrom;

a rotatable member placed between and connecting the first and second side walls for providing a force on said at least one end plate of the spool to retain frictional contact between the spool and the support member while the spool is rotating to control the dispensing of the wire; and at least one wire spool.

13. The wire dispenser of claim 12, wherein a plurality of wire spools, each of the same size, are included therein.

14. The wire dispenser of claim 12, wherein the wire spool has two end plates.

* * * * *